US011127229B2

(12) United States Patent
Thompson

(10) Patent No.: US 11,127,229 B2
(45) Date of Patent: Sep. 21, 2021

(54) AUTO CALIBRATION AND AUTO RESET OF VEHICLE COMPONENTS

(71) Applicant: TOYOTA MOTOR ENGINEERING & MANUFACTURING NORTH AMERICA, INC., Plano, TX (US)

(72) Inventor: Derek A. Thompson, Ypsilanti, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 252 days.

(21) Appl. No.: 16/358,001

(22) Filed: Mar. 19, 2019

(65) Prior Publication Data

US 2020/0302708 A1 Sep. 24, 2020

(51) Int. Cl.
*G07C 5/08* (2006.01)
*G07C 5/00* (2006.01)

(52) U.S. Cl.
CPC ..... *G07C 5/0808* (2013.01); *G07C 5/006* (2013.01); *G07C 5/0825* (2013.01); *G07C 5/0833* (2013.01)

(58) Field of Classification Search
CPC .. G07C 5/0808; G07C 5/0833; G07C 5/0825; G07C 5/006; G07C 5/0816
See application file for complete search history.

(56) References Cited

U.S. PATENT DOCUMENTS

| | | | | |
|---|---|---|---|---|
| 8,141,300 | B2 | 3/2012 | Heckmann et al. | |
| 2002/0103583 | A1 | 8/2002 | Ohmura et al. | |
| 2013/0226394 | A1* | 8/2013 | Amirpour | G01M 17/007 701/31.4 |
| 2018/0095609 | A1* | 4/2018 | Merg | G06F 3/0482 |

FOREIGN PATENT DOCUMENTS

| | | | |
|---|---|---|---|
| CN | 206945267 | U | 1/2018 |
| FR | 3067122 | A1 | 12/2018 |

* cited by examiner

*Primary Examiner* — Brian P Sweeney
(74) *Attorney, Agent, or Firm* — Haynes and Boone, LLP

(57) ABSTRACT

Disclosed is a vehicle accessory calibration and reset module that includes a sensor associated with a vehicle component, and configured to detect a malfunction of the vehicle component, and generate a signal to indicate the malfunction. The vehicle accessory calibration and reset module also includes a control unit configured to receive the signal indicative of the malfunction, automatically identify a diagnostic procedure for the vehicle component, initiate the diagnostic procedure, determine whether a calibration or reset is indicated as part of the diagnostic procedure, initiate an automatic calibration or reset of the vehicle component, initiate a test of the vehicle component, and recommend service options to a user if a result of the test indicates a continuing malfunction status of the vehicle component.

20 Claims, 5 Drawing Sheets

AUTO CALIBRATION AND AUTO RESET OF VEHICLE COMPONENTS

TECHNICAL FIELD

The subject matter described herein relates generally to enabling vehicles to perform automatic calibration and reset of apparently malfunctioning vehicle components. This method has particular but not exclusive utility for consumer and commercial cars and trucks with software, electronic, and electromechanical accessories and components.

BACKGROUND

Modern vehicles include complex electronic, software, and electromechanical accessories, components, and subsystems, including power seats, seatbelts, sunroofs, sun shades, running boards, fold-out mirrors, mirror heaters, lane departure warning systems, and others. Such components, accessories, and subsystems are subject to breakdown and malfunction. Currently, a vehicle owner can refer to a user's manual (including a digital or online user's manual) to look up the possible causes for a problem with a vehicle component (e.g., a sunroof ceases to operate, power running boards fail to extend, or another fault is detected on a power component). Based on the problem, a user manual may suggest that the power component needs to be replaced, a fuse is burnt out, or needs to be re-calibrated or reset.

Often, owners are unaware that component recalibration, component reset, and system reset options are available at all, as many issues appear to be electrical or mechanical failures, which may lead an owner to believe taking the vehicle to a service station is the only way to have the fault repaired.

For these and other reasons, current user's manuals and owner-accessible diagnostic and repair systems present numerous unaddressed challenges in the art. Accordingly, long-felt needs exist for diagnostic and repair systems that address the forgoing or other concerns.

The information included in this Background section of the specification is included for technical reference purposes only and is not to be regarded as subject matter by which the scope of the disclosure is to be bound.

SUMMARY

Disclosed are apparatus, systems, and methods for enabling vehicles to perform automatic calibration and reset of apparently malfunctioning automotive components or vehicle components, the apparatus, systems, and methods henceforth referred to collectively as an "automatic calibration and reset system." The automatic calibration and reset system may detect faults and intervene with calibration and reset actions, either with or without input from the user or vehicle owner.

One general aspect includes a vehicle including an automotive component calibration and reset system, the system including: one or more components of the vehicle, a sensor associated with a component of the one or more components, the sensor being configured to detect a malfunction of the component and generate a signal indicative of the malfunction. The vehicle also includes a user interface; and a control unit configured to: receive a signal from the sensor identifying at least one malfunctioning component of the one or more components of the vehicle, automatically identify a diagnostic procedure for at least one malfunctioning component from a plurality of diagnostic procedures and initiate the identified diagnostic procedure, determine whether a calibration or reset is procedurally indicated as part of the diagnostic procedure for the at least one malfunctioning component, initiate an automatic calibration or reset of the at least one malfunctioning component, initiate a test of the at least one malfunctioning component, and recommend service options to a user if a result of the test indicates the at least one malfunctioning component continues to malfunction.

A system of one or more control units can be configured to perform particular operations or actions by virtue of having software, firmware, hardware, or a combination of them installed on the system that in operation causes or cause the system to perform the actions. One or more diagnostic procedures can be configured to perform particular operations or actions by virtue of including instructions that, when executed by data processing apparatus, cause the apparatus to perform the actions. Other embodiments of this aspect include corresponding control units, apparatus, and diagnostic procedures recorded on one or more control-unit-accessible storage devices, each configured to perform the actions of the methods.

Implementations may include one or more of the following features. The vehicle where the control unit is further configured to interrogate the user using the user interface regarding one or more performance parameters relating to the at least one malfunctioning component. The vehicle where the control unit is further configured to interrogate the user regarding the result of the test. The vehicle where initiating the test involves a user input. The vehicle where the interrogation of the user involves a voice interface. The vehicle where the interrogation of the user involves a visual interface. The vehicle where the interrogation of the user involves a dashboard head unit. The vehicle where the interrogation of the user involves a portable device. The vehicle where the at least one malfunctioning component includes an electromechanical component. The vehicle where the at least one malfunctioning component includes an electronic component. The vehicle where the at least one malfunctioning component includes a software component. Implementations of the described techniques may include hardware, a method or process, or computer software on a computer-accessible medium.

One general aspect includes a method for returning malfunctioning automotive components to working condition, the method including: detecting a status of at least one malfunctioning component of one or more vehicle components by receiving a signal from a sensor, identifying a diagnostic procedure stored in a memory from a plurality of diagnostic procedures stored in the memory, executing the identified diagnostic procedure from the memory for the at least one malfunctioning component, determining whether a calibration or reset is indicated as a part of the identified diagnostic procedure for the at least one malfunctioning component, initiating an automatic calibration or reset of the at least one malfunctioning component, performing an automated test of the at least one malfunctioning component, and if a result of the automated test indicates the at least one malfunctioning component continues to malfunction, recommending service options to a user. Other embodiments of this aspect include corresponding control units, apparatus, and diagnostic procedures recorded on one or more control-unit-accessible storage devices, each configured to perform the actions of the methods.

Implementations may include one or more of the following features. The method further including receiving input from a user, the input selected from: an input indicating that a component is malfunctioning; one or more performance parameters relating to the at least one malfunctioning component; and the result of the automated test. The method where the input from the user involves a voice interface or visual interface. The method where the input from the user involves a dashboard head unit or portable device. The method where the at least one malfunctioning component includes an electromechanical component, an electronic component, or a software component. Implementations of the described techniques may include hardware, a method or process, or diagnostic procedures or fault trees on a control-unit-accessible medium.

One general aspect includes a vehicle accessory calibration and reset module including: a sensor disposed within a vehicle, the sensor being associated with a vehicle component and configured to detect a malfunction of the vehicle component, and generate a signal indicative of the malfunction. The vehicle accessory calibration also includes a control unit configured to: receive the signal indicative of the malfunction, automatically identify a diagnostic procedure for the vehicle component from a plurality of diagnostic procedures and initiate the identified diagnostic procedure, determine whether a calibration or reset is indicated as part of the diagnostic procedure for the vehicle component, initiate an automatic calibration or reset of the vehicle component, initiate a test of the vehicle component, and recommend service options to a user if a result of the test indicates a malfunction status of the vehicle component. Other embodiments of this aspect include corresponding control units, apparatus, and diagnostic procedures or fault trees recorded on one or more control-unit-accessible storage devices, each configured to perform the actions of the methods.

Implementations may include one or more of the following features. The vehicle accessory calibration and reset module where the control unit is further configured to receive input from the user selected from: the malfunction status of the vehicle component, one or more performance parameters relating to the vehicle component, and the result of the test. The vehicle accessory calibration and reset module where the input from the user involves a vehicle head unit or portable device including a visual interface or voice interface. The vehicle accessory calibration and reset module where the vehicle component includes an electromechanical component, an electronic component, or a software component. Implementations of the described techniques may include hardware, a method or process, or diagnostic procedures or fault trees on a control-unit-accessible medium.

The automatic calibration and reset system disclosed herein has particular, but not exclusive, utility for consumer and commercial cars and trucks with software, electronic, and electromechanical accessories and components.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the method, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
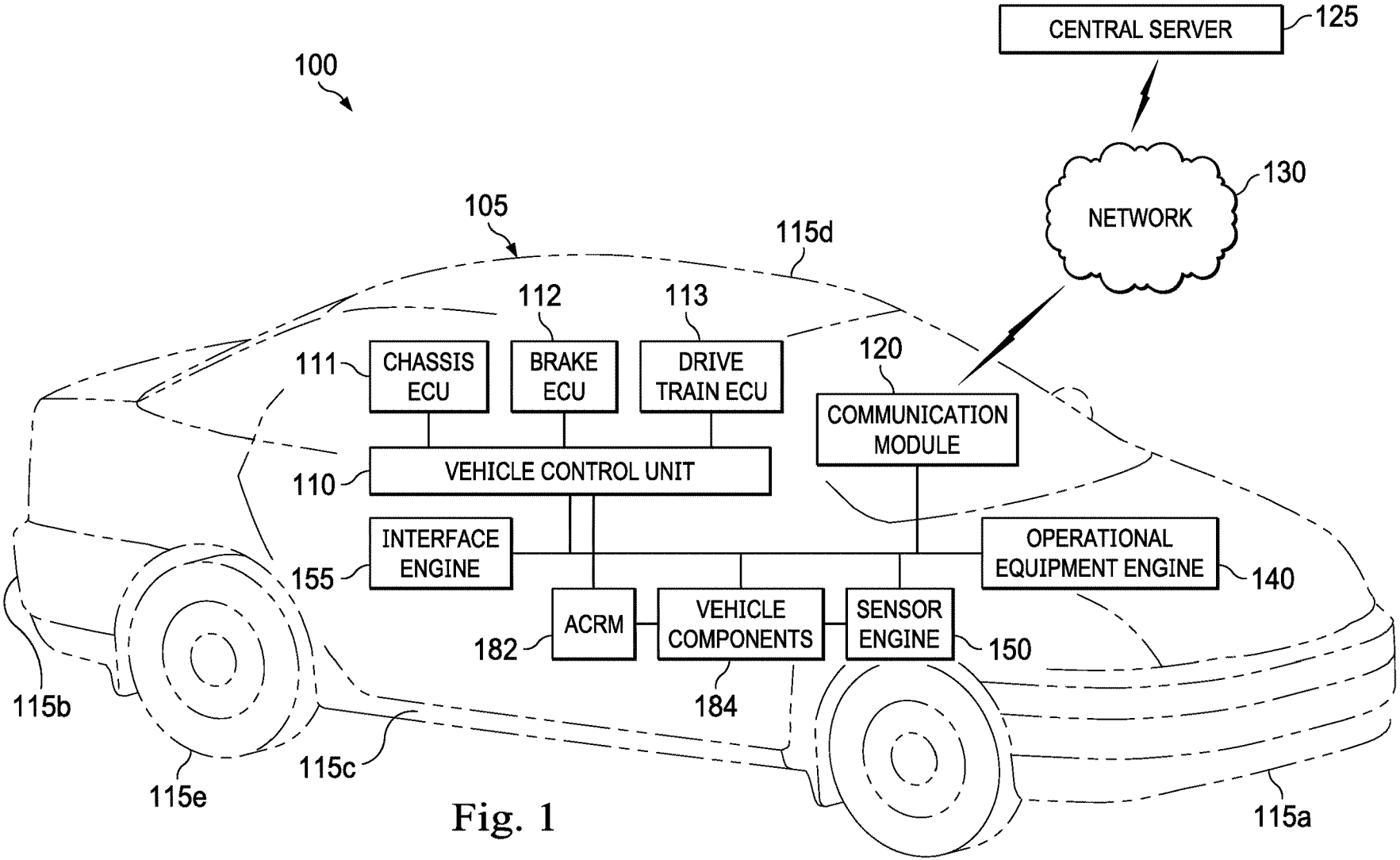
FIG. 1 is a diagrammatic illustration of a vehicle including an automatic calibration and reset system, in accordance with at least one embodiment of the present disclosure.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. It is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

The automatic calibration and reset system of the present disclosure provides an interactive, semi-autonomous, or fully autonomous troubleshooting guide wherein the vehicle automatically performs the troubleshooting steps of recalibrating or resetting certain vehicle components based on voice activation, virtual agent, multimedia, or touch input describing the problem in a question/answer type format through the vehicle head unit or connected mobile device, or through sensors internal to the vehicle. In some embodiments, the system operates fully autonomously (e.g., detecting and correcting faults without user input). In other embodiments, the system performs autonomous checks and corrective actions but also seeks input from the user (e.g., to confirm that a particular component is now working.)

The present disclosure aids substantially in vehicle component fault correction, by improving the ability of vehicles to overcome certain malfunctions in an automated manner, without the need for professional service or complex actions undertaken by a vehicle owner. Implemented on a processor in communication with a sensor associated with the malfunctioning component, the automatic calibration and reset system disclosed herein provides practical self-diagnosis and self-repair capabilities to motor vehicles. This streamlined and augmented diagnostic and repair capability may transform a non-functioning vehicle component into a functioning one. This unconventional approach improves the functioning and uptime of the vehicle while reducing cost of ownership, by automatically restoring malfunctioning vehicle components to working condition without visiting a repair facility.

The automatic calibration and reset system may comprise a subroutine that includes a user interface viewable on a display, and operated by an algorithm executing on a processor that may accept user inputs from a voice, gesture, or touchscreen interface, and that is in communication with one or more sensors and one or more actuators. In that regard, the algorithm performs certain specific operations in response to different conditions, including but not limited to sensor readings and user inputs. Certain structures, functions, and operations of the processor, display, sensors, and user input systems are known in the art, while others are recited herein to enable novel features or aspects of the present disclosure with particularity.

These descriptions are provided for exemplary purposes, and should not be considered to limit the scope of the automatic calibration and reset system. Certain features may be added, removed, or modified without departing from the spirit of the claimed subject matter.

FIG. 1 is a diagrammatic illustration of a vehicle including an automatic calibration and reset system, in accordance with at least one embodiment of the present disclosure. In an example, automatic calibration and reset system is referred to by the reference numeral 100 and includes a vehicle 105, such as an automobile, and a vehicle control unit 110 located on the vehicle 105. The vehicle 105 may include a front portion 115*a* (including a front bumper), a rear portion 115*b* (including a rear bumper), a right side portion 115*c* (including a right front quarter panel, a right front door, a right rear door, and a right rear quarter panel), a left side portion 115*d* (including a left front quarter panel, a left front door, a left rear door, and a left rear quarter panel), and wheels 115*e*. A communication module 120 is operably coupled to, and adapted to be in communication with, the vehicle control unit 110. The communication module 120 is adapted to communicate wirelessly with a central server 125 via a network 130 (e.g., a 3G network, a 4G network, a 5G network, a Wi-Fi network, or the like). The central server 125 may provide information and services including but not limited to include location, mapping, scheduling, SMS, and email.

An operational equipment engine 140 is operably coupled to, and adapted to be in communication with, the vehicle control unit 110. A sensor engine 150 is operably coupled to, and adapted to be in communication with, the vehicle control unit 110. The sensor engine 150 is adapted to monitor various components of, for example, the operational equipment engine 140, as will be described in further detail below. An interface engine 155 is operably coupled to, and adapted to be in communication with, the vehicle control unit 110. In addition to, or instead of, being operably coupled to, and adapted to be in communication with, the vehicle control unit 110, the communication module 120, the operational equipment engine 140, the sensor engine 150, and/or the interface engine 155 may be operably coupled to, and adapted to be in communication with, another of the components via wired or wireless communication (e.g., via an in-vehicle network). In some examples, the vehicle control unit 110 is adapted to communicate with the communication module 120, the operational equipment engine 140, the sensor engine 150, and the interface engine 155 to control at least partially the interaction of data with and between the various components of the automatic calibration and reset system 100.

The term "engine" is meant herein to refer to an agent, instrument, or combination of either, or both, agents and instruments that may be associated to serve a purpose or accomplish a task—agents and instruments may include sensors, actuators, switches, relays, power plants, system wiring, computers, components of computers, programmable logic devices, microprocessors, software, software routines, software modules, communication equipment, networks, network services, and/or other elements and their equivalents that contribute to the purpose or task to be accomplished by the engine. Accordingly, some of the engines may be software modules or routines, while others of the engines may be hardware and/or equipment elements in communication with any or all of the vehicle control unit 110, the communication module 120, the network 130, or a central server 125.

In this example, the vehicle 105 also includes a chassis electronic control unit (ECU) 111 which controls elements of the vehicle's suspension system, a brake ECU 112 which controls the braking system or elements thereof, and a drive train ECU 113 (variously known as an engine ECU, power plant ECU, or motor ECU) that controls elements of the motor and drivetrain. A reader of ordinary skill in the art will understand that other components or arrangements of components may be found in a vehicle 105, and that the same general principles apply to electric vehicles, internal combustion vehicles, and hybrid vehicles.

In some embodiments, the automatic calibration and reset system 100 further includes an Automatic Calibration and Reset Module (ACRM) 182 in communication with vehicle components 184.

Figure 2:
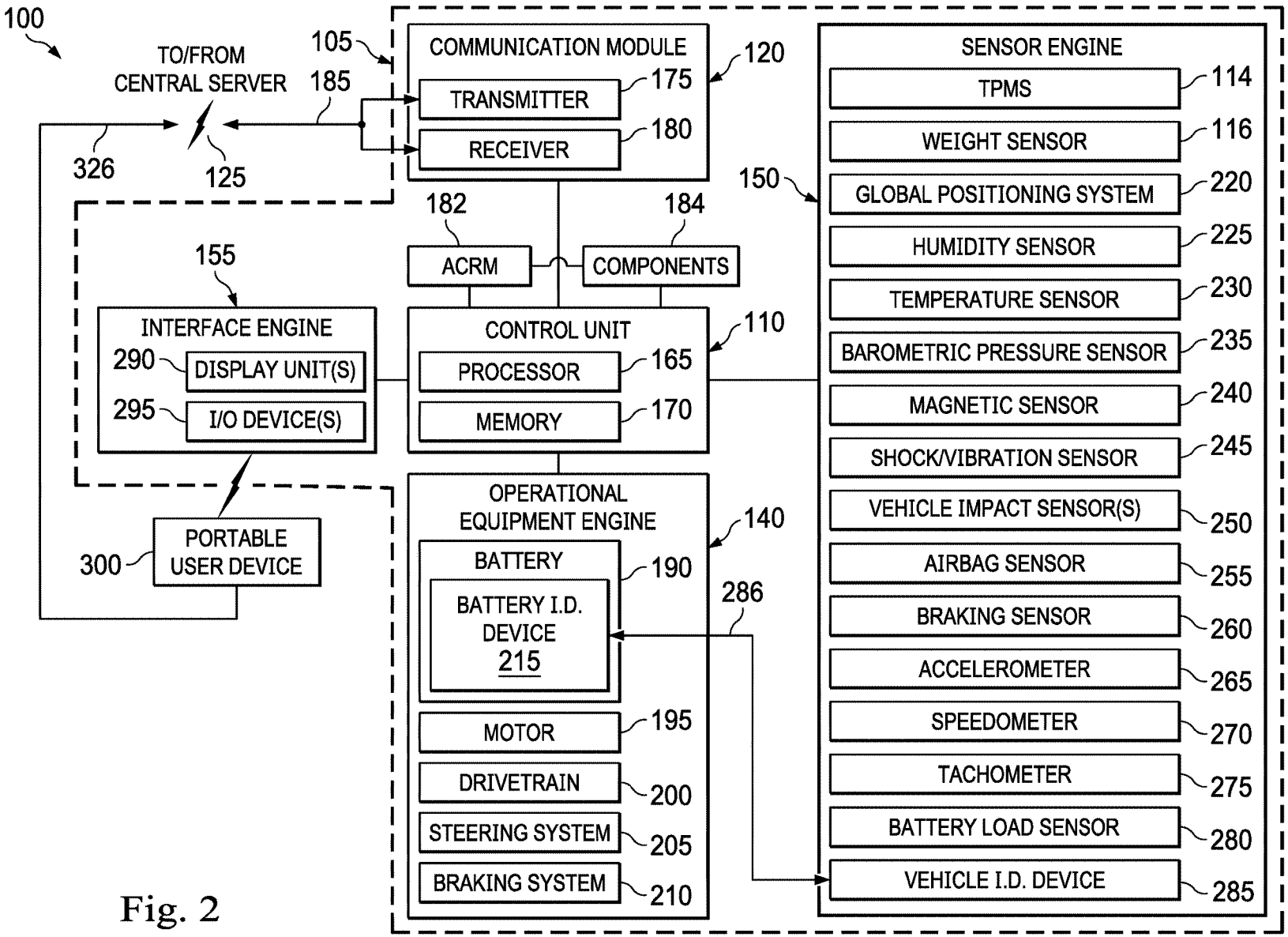
FIG. 2 is a block diagram including several components of the automatic calibration and reset system of FIG. 1, in accordance with at least one embodiment of the present disclosure.

FIG. 2 is a block diagram including several components of the automatic calibration and reset system 100 of FIG. 1, in accordance with at least one embodiment of the present disclosure. It is worth noting that the components of the vehicle 105 may be located either permanently or temporarily as a part of the vehicle 105. The vehicle control unit (VCU) 110 includes a processor 165 and a memory 170. In some examples, the communication module 120, which is operably coupled to, and adapted to be in communication with, the vehicle control unit 110, includes a transmitter 175 and a receiver 180. In some examples, one or the other of the transmitter 175 and the receiver 180 may be omitted according to the particular application for which the communication module 120 is to be used. In other examples, the transmitter 175 and receiver 180 are combined into a single transceiver that performs both transmitting and receiving functions.

In some examples, the operational equipment engine 140, which is operably coupled to, and adapted to be in communication with, the vehicle control unit 110, includes a plurality of devices configured to facilitate driving of the vehicle 105. In this regard, the operational equipment engine 140 may be designed to exchange communication with the vehicle control unit 110, so as to not only receive instructions, but to provide information on the operation of the operational equipment engine 140. For example, the operational equipment engine 140 may include a vehicle battery 190, a motor 195, a drivetrain 200, a steering system 205, and a braking system 210. In an example, the vehicle battery 190 provides electrical power to the motor 195 to drive the wheels 115*e* of the vehicle 105 via the drivetrain 200. In some examples, in addition to providing power to the motor 195 to drive the wheels 115*e* of the vehicle 105 via the drivetrain 200, the vehicle battery 190 provides electrical power to another component of the operational equipment engine 140, the vehicle control unit 110, the communication module 120, the sensor engine 150, the interface engine 155, or any combination thereof. In some examples, the vehicle battery 190 includes a battery identification device 215. The battery identification device 215 is adapted to communicate with one or more components of the sensor engine 150, and stores data identifying the vehicle battery 190 such as, for example, manufacturing information (e.g., production date, production facility, etc.), battery characteristic(s) information, battery identification number information, electric vehicle compatibility information, or the like.

In some examples, the sensor engine 150, which is operably coupled to, and adapted to be in communication with, the vehicle control unit 110, includes devices such as sensors, meters, detectors, or other devices configured to measure or sense a parameter related to a driving operation or other operation of the vehicle 105. For example, the sensor engine 150 may include a global positioning system 220, a humidity sensor 225, a temperature sensor 230, a barometric pressure sensor 235, a magnetic sensor 240, a shock/vibration sensor 245, a vehicle impact sensor 250, an airbag sensor 255, a braking sensor 260, an accelerometer 265, a speedometer 270, a tachometer 275, a battery load sensor 280, a vehicle identification device 285, a TPMS 114, a weight sensor 116, or any combination thereof. The sensors or other detection devices may be configured to sense or detect activity, conditions, and circumstances in an area to which the device has access, e.g., ambient conditions or conditions within a battery compartment. Sub-components of the sensor engine 150 may be deployed at any operational area where information on the driving of the vehicle 105 may occur. Readings from the sensor engine 150 are fed back to the vehicle control unit 110. Stored and reported performance data may include the sensed data, or may be derived, calculated, or inferred from sensed data. The vehicle control unit 110 may send signals to the sensor engine 150 to adjust the calibration or operating parameters of the sensor engine 150 in accordance with a control program in the vehicle control unit 110. The vehicle control unit 110 is adapted to receive and process performance data from the sensor engine 150 or from other suitable source(s), and to monitor, store (e.g., in the memory 170), and/or otherwise process (e.g., using the processor 165) the received performance data.

The braking sensor 260 is adapted to monitor usage of the vehicle 105's braking system 210 (e.g., an antilock braking system 210) and to communicate the braking information to the vehicle control unit 110. The accelerometer 265 is adapted to monitor acceleration of the vehicle 105 and to communicate the acceleration information to the vehicle control unit 110. The accelerometer 265 may be, for example, a two-axis accelerometer 265 or a three-axis accelerometer 265. In some examples, the accelerometer 265 is associated with an airbag of the vehicle 105 to trigger deployment of the airbag. The speedometer 270 is adapted to monitor speed of the vehicle 105 and to communicate the speed information to the vehicle control unit 110. In some examples, the speedometer 270 is associated with a display unit of the vehicle 105 such as, for example, a display unit of the interface engine 155, to provide a visual indication of vehicle speed to a driver of the vehicle 105. The tachometer 275 is adapted to monitor the working speed (e.g., in revolutions-per-minute) of the vehicle 105's motor 195 and to communicate the angular velocity information to the vehicle control unit 110. In some examples, the tachometer 275 is associated with a display unit of the vehicle 105 such as, for example, a display unit of the interface engine 155, to provide a visual indication of the motor 195's working speed to the driver of the vehicle 105. The battery load sensor 280 is adapted to monitor charging, discharging, and/or overcharging of the vehicle battery 190 and to communicate the charging, discharging, and/or overcharging information to the vehicle control unit 110.

In some examples, the vehicle identification device 285 stores data identifying the vehicle 105 such as, for example, manufacturing information (e.g., make, model, production date, production facility, etc.), vehicle characteristic(s) information, vehicle identification number ("VIN") information, battery compatibility information, or the like. The vehicle identification device 285 is adapted to communicate with the battery identification device 215 (or vice versa), as indicated by arrow 286. In some examples, the vehicle identification device 285 and the battery identification device 215 may each communicate with the vehicle control unit 110.

In some examples, the interface engine 155, which is operably coupled to, and adapted to be in communication with, the vehicle control unit 110, includes at least one input and output device or system that enables a user to interact with the vehicle control unit 110 and the functions that the vehicle control unit 110 provides. For example, the interface engine 155 may include a display unit 290 and an input/output ("I/O") device 295. The display unit 290 may be, include, or be part of multiple display units. In some examples, the display unit 290 may include one, or any combination, of a central display unit associated with a dash of the vehicle 105, an instrument cluster display unit associated with an instrument cluster of the vehicle 105, and/or a heads-up display unit associated with the dash and a windshield of the vehicle 105; accordingly, as used herein the reference numeral 290 may refer to one, or any combination, of the display units. The I/O device 295 may be, include, or be part of a communication port (e.g., a USB port), a Bluetooth communication interface, a tough-screen display unit, soft keys associated with a dash, a steering wheel, or another component of the vehicle 105, and/or similar components. Other examples of sub-components that may be part of the interface engine 155 include, but are not limited to, audible alarms, visual alerts, telecommunications equipment, and computer-related components, peripherals, and systems.

In some examples, a portable user device 300 operated by an occupant of the vehicle 105 may be coupled to, and adapted to be in communication with, the interface engine 155. For example, the portable user device 300 may be coupled to, and adapted to be in communication with, the interface engine 155 via the I/O device 295 (e.g., the USB port and/or the Bluetooth communication interface). In an example, the portable user device 300 is a handheld or otherwise portable device which is carried onto the vehicle 105 by a user who is a driver or a passenger on the vehicle 105. In addition, or instead, the portable user device 300 may be removably connectable to the vehicle 105, such as by temporarily attaching the portable user device 300 to the dash, a center console, a seatback, or another surface in the vehicle 105. In another example, the portable user device 300 may be permanently installed in the vehicle 105. In some examples, the portable user device 300 is, includes, or is part of one or more computing devices such as personal computers, personal digital assistants, cellular devices, mobile telephones, wireless devices, handheld devices, laptops, audio devices, tablet computers, game consoles, cameras, and/or any other suitable devices. In several examples, the portable user device 300 is a smartphone such as, for example, an iPhone® by Apple Incorporated.

In some embodiments, the automatic calibration and reset system 100 further includes an Automatic Calibration and Reset Module (ACRM) 182. The ACRM 182 may be a software module, a hardware module, a firmware module, or any combination thereof, and may be a standalone module or may be integrated into other vehicle components such as the VCU 110 or Sensor Engine 150. In these embodiments, the ACRM is in communication with resettable or calibrateable vehicle components 184, either by receiving data from sensors associated with each component 184 (e.g., linear encoders, rotary encoders, voltage sensors, or current sensors), by receiving data from status variables associated with each component (e.g., status bits, status bytes, status words, or error codes), or by exchanging other data with an ECU or VCU associated with the component 184.

A reader of ordinary skill in the art will understand that other components or arrangements of components may be found in a vehicle 105, and that the same general principles apply to electric vehicles, internal combustion vehicles, and hybrid vehicles.

Figure 3:
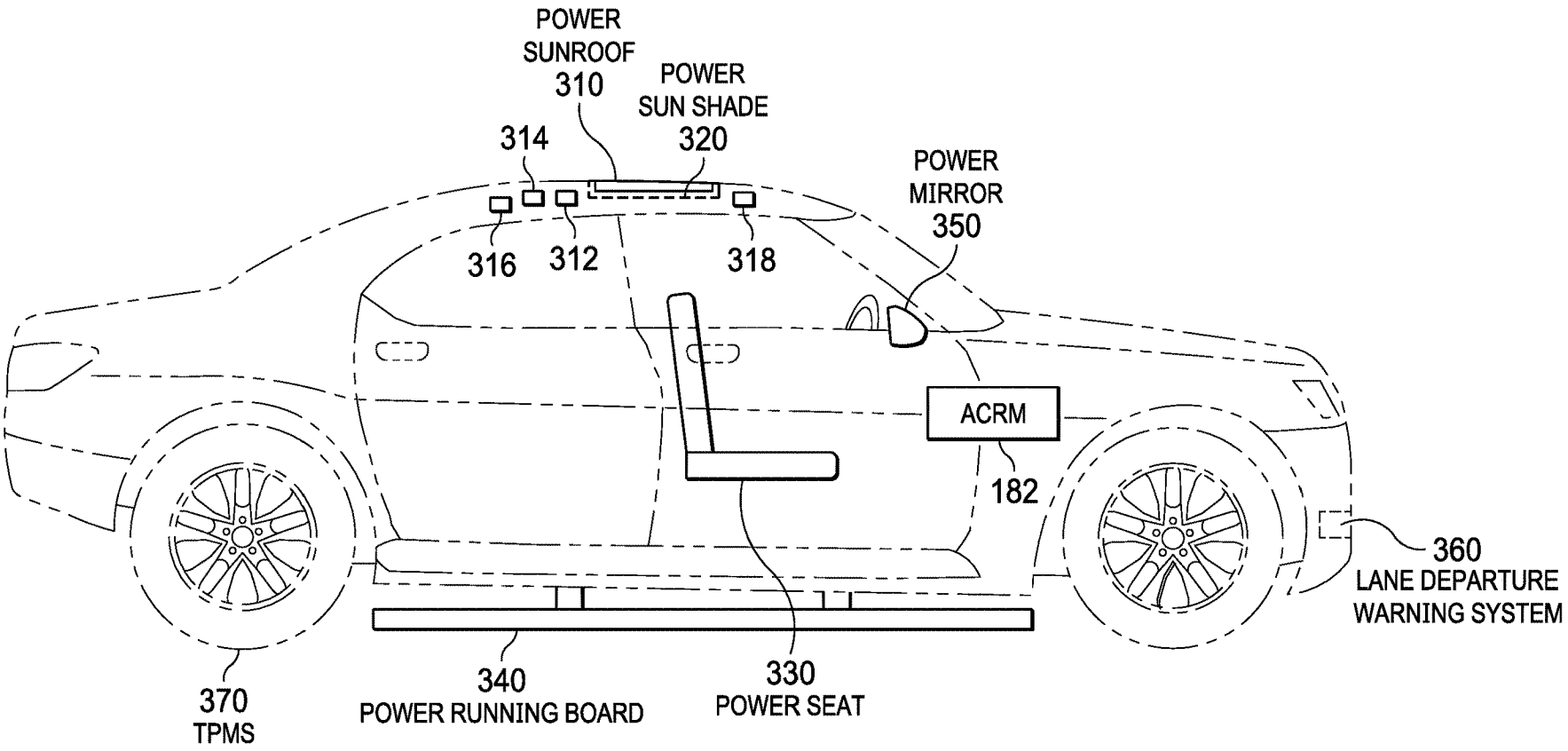
FIG. 3 is a diagrammatic illustration of an example vehicle including electromechanical, electronic, and software accessories, components, and subsystems.

FIG. 3 is a diagrammatic illustration of an example vehicle 105 including electronic, software, and electromechanical accessories, components, and subsystems in accordance with at least one embodiment of the present disclosure. In the example shown in the figure, the vehicle 105 includes a power sunroof 310, power sun shade 320, power seat 330, power running board 340, power mirror 350, lane departure warning system (LDWS) 360, and Tire Pressure Monitoring System (TPMS) 370.

Electromechanical accessories like the power sunroof 310 may include additional subcomponents such as an accessory motor or actuator 312, position encoder 314, accessory electronic control unit (ECU) 316, and switch 318. In some instances, failures in an electromechanical accessory may be mechanical in nature (e.g., a broken motor 312), or electronic (e.g., a shorted ECU 316), or electrical (e.g., a blown fuse), in which case, physical replacement of the failed components may be the only way to restore the accessory to an operational state. In other instances, failure of the component may involve software or firmware in a safe mode, maintenance mode, or hang state.

Other subsystems, such as the LDWS 360 and TPMS 370, comprise one or more physical sensors (indicated in the figure), but operate largely as software (e.g., operating in the VCU 110 or in an ECU 316). Failures in such components may involve a physical failure of the sensor, or may involve may involve software or firmware in a safe mode, maintenance mode, or hang state. For example, TMPS sensors 370 may report an error when a tire is replaced, even if the replacement tire is at normal operating pressure. Resetting the sensor 370 may clear this error condition.

Still other subsystems may exist purely as software. Examples include but are not limited to range estimation, load estimation, and dynamic adjustment of operational parameters such as chassis or suspension parameters. These and other subsystems may enter exception handler states for a variety of reasons, including but not limited to temporary low operating voltage for a VCU 110 or ECU 316.

Some vehicle accessories, components, or subsystems (e.g., a power sunroof) may include a dedicated ECU. In other cases, a single ECU may control multiple accessories, components, or subsystems (e.g., a body ECU may control lights, door locks, and other functions).

System reset or re-calibration is a common solution for fault-based errors relating to software, electronic, or electromechanical components. However, identifying this is as a solution is not always clear to an end user or vehicle owner. The user may then have to take the vehicle to a service station to check the switch, motor, electrical connections, etc. only to find out that the best solution was simply to reset or recalibrate the component.

For example, attempting to open the power sunroof when frozen or when an obstruction is present causes the system to time out and enter an inoperable state, to prevent excessive stall current from damaging electronics or electromechanical actuators. However, this can be corrected simply by recalibrating the sunroof, which is a very simple procedure: turning the ignition key ON and pressing the sunroof button for 20 seconds. When this is done, the sunroof returns back to a home position, and the controls are reinstated. Such procedures are typically outlined in a vehicle's user manual, but require the user to go through multiple unfamiliar steps. Furthermore, the user does not necessarily know that the components needs to be recalibrated or reset, or that such resetting or recalibration is a likely solution to restore the inoperable component to an operable state.

In some embodiments, to improve the user experience and streamline diagnostic procedures, the automatic calibration and reset system identifies when a recalibration is likely the solution based on a description provided by the operator and then automatically re-calibrates the component (e.g., power running boards, power windows, sunroof, power extend mirrors, auto fold side view mirrors, power seats, power sun shades, etc.) without requiring the owner to perform the steps needed to initiate the system into a "manufacture's mode," which is typically the mode where re-calibration or reset is activated. Thus, the user need not be aware that a recalibration was required, or that one has occurred.

In some embodiments, the automatic calibration and reset system receives an input from the user (e.g. via voice, virtual agent, or touch input), which identifies a problem. If more information is required, the system may ask questions of the user until the provided information describes or isolates the problem sufficiently that the system identifies that a recalibration or reset of the component should be attempted. In some instances, such a recalibration or reset will either resolve the problem or else further isolate a root cause of the problem and thus narrow the list of possible remedies. In some embodiments, once the component is reset or recalibrated, the automatic calibration and reset system asks the user to confirm whether the power component is functioning properly. If not, the system will continue asking questions relating to the diagnosis and then automatically reset additional components or systems relating to the described problem. In other embodiments, the system automatically detects whether the component is working (e.g., by reading a position encoder to confirm that an actuator is moving).

The process continues until the problem is resolved, which is usually the case for most fault detection issues. In instances where the root cause of a problem is mechanical or electrical in nature and cannot be completely resolved by resetting or recalibrating one or more components, the automatic calibration and reset system may provide additional troubleshooting steps that the user may perform to isolate the problem, or recommend to the user that the vehicle be professionally serviced.

The automatic calibration and reset system of the present disclosure provides a simple, convenient, and cost-effective method to aid in the resolution of problems that occur when a power system (e.g., power running boards, power windows, sunroof, power extend mirrors, auto fold side view mirrors, power seats, power sun shades, etc.) ceases to operate due to a detected fault or system malfunction, or when an electronic or software subsystem enters a hang state or exception state.

In some embodiments, the automatic calibration and reset system begins troubleshooting the problem by asking a series of questions. This may start with questions directly relating to the onset of the problem. In other instances, the system begins troubleshooting by reading sensor values internal to the vehicle. If the answers suggest that a system reset or re-calibration will be helpful, either in resolving the issue or in further isolating a fault, the automatic calibration and reset system may automatically perform the steps required to reset or re-calibrate one or more components of the vehicle, without any specific assistance or intervention required from the user.

In some instances, the automatic calibration and reset system may calibrate or reset a sensor (e.g., a tire pressure monitoring system or TPMS sensor), or actuator (e.g., a window, sunroof, or sun shade motor) that is part of a malfunctioning subsystem. In other instances, the automatic calibration and reset system may calibrate or reset an electronic control unit (ECU) that is part of or local to the malfunctioning component or subsystem. In still other instances, the automatic calibration and reset system may reset the entire vehicle (e.g., by resetting a Vehicle Control Unit or VCU).

In instances where user interaction is employed, the user may provide problem descriptions and answer questions through voice interaction, touchscreen, or any combination of audio, visual, gesture, selectable image, or virtual agent interaction. In some embodiments, auto-calibration or reset procedures are stored in an onboard database, or in a remote database accessed through a wireless network, server connection, or cloud storage device.

Figure 4:
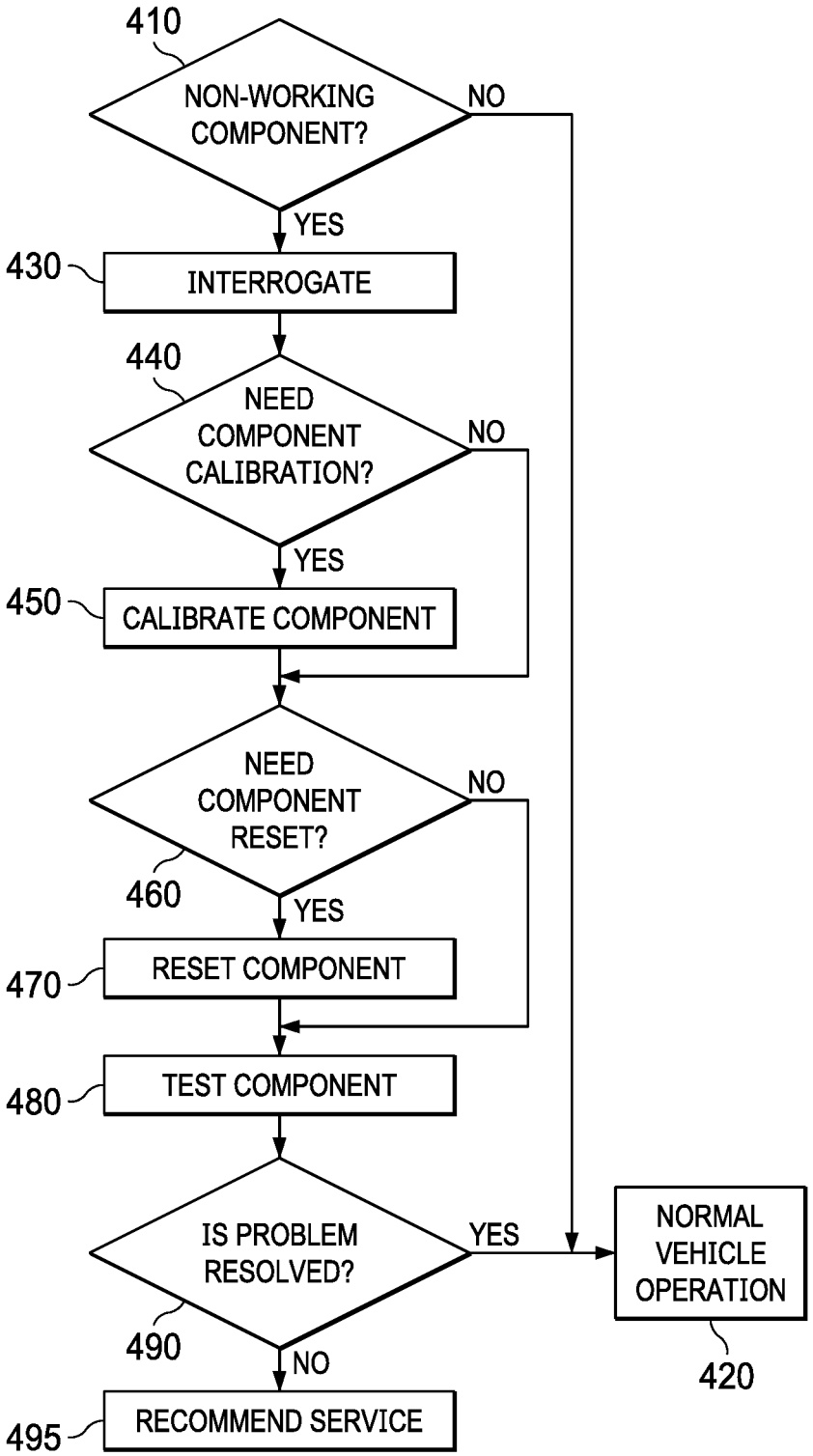
FIG. 4 is a flow diagram showing exemplary process steps undertaken by an automatic calibration and reset system according to at least one embodiment of the present disclosure.

FIG. 4 is a flow diagram showing exemplary process steps undertaken by an automatic calibration and reset system 100 or method according to at least one embodiment of the present disclosure.

In an example, the method begins with step 410, in which a determination is made as to whether there is a nonworking component. In some embodiments, this determination is accepted as an input from the user. For example, the user might activate a user interface (e.g., operating on the interface engine 155 or portable device 300) and select a menu option indicating that the vehicle sunroof 310 is not working. In other embodiments, this determination is made based on a sensor reading or self-test function. For example, if a user actuates a sunroof motor 312, and an error code is generated by an ECU 316 or VCU 110, or readings from an encoder 314 indicate that the sunroof did not move, then the automatic calibration and reset system or method 100 may conclude that a problem exists either with the motor 312, the encoder 314, the ECU 316, or the switch 318, or else with supporting electronics such as a wire or fuse.

If a nonworking component is not present, the system or method 100 proceeds to step 420, which is normal operation of the vehicle. If a nonworking component is present, the system or method 100 proceeds to step 430.

In step 430, the automatic calibration and reset system or method 100 gathers additional information (e.g., performance parameters) through an interrogation process. In some embodiments, this process involves asking questions of a user, operator, or vehicle owner. For example, the system might ask, "Is the temperature below freezing?" or "Did the sunroof stop working suddenly, or gradually?" Depending on the accessory, component, or subsystem at fault, the questions will be sufficient to determine whether a calibration or reset action is called for by standard maintenance or service procedures. In other embodiments, this interrogation process involves checking current and historical readings of sensor logs (e.g., thermometer, encoder, or current sensor) or self-test functions (e.g., error codes, alarm codes, or status indicators) to gain information related to the malfunction in order to facilitate the same determination. In still other embodiments, a combination of user interrogation, sensor interrogation, and self-test interrogation is employed. In an example, when sunroof does not open or close as commanded, the system 100 determines whether the temperature was recently below freezing, making it likely that the sunroof was immobilized by ice. In another example, the system 100 determines whether the temperature was recently unusually high (e.g., above 110° F.), making it likely that the sunroof has been immobilized by thermal expansion.

In step 440, based on any combination of user inputs, sensor readings, or self-test values, the actual determination is made as to whether a calibration step would be indicated or called for as part of an identified diagnostic procedure, maintenance or service procedure selected for the particular component or symptom in question from among a plurality of service options. Such a determination may be made with the aid of a database either stored locally within the vehicle or accessed through a remote server 125. If a calibration step is called for, then the system or method proceeds to step 450, where the calibration is performed automatically, without any required intervention by the user (e.g., rotating the ignition key or operating switches). In an example, a sunroof has entered a timeout or current limiting state after being immobilized by ice or thermal expansion, and can be returned to working condition through a calibration step. Regardless of whether a calibration is performed, the system or method 100 then proceeds to step 460.

In step 460, based on any combination of user inputs, sensor readings, or self-test values, a determination is made as to whether a reset step would be called for under normal maintenance or service procedures. This determination is made using the same methods described above for a calibration step. If a reset step is called for, the system or method 100 proceeds to step 470, and the actual reset is performed automatically. In an example, a sunroof has entered a timeout or current limiting state after being immobilized by ice or thermal expansion, and can be returned to working condition through a reset step. Regardless of whether a reset is performed, execution then proceeds to step 480.

In step 480, the component is tested. In some embodiments, this testing involves providing an instruction to the user (e.g., to attempt to operate the malfunctioning component), and soliciting feedback from the user (e.g., whether the behavior of the component has changed). In other embodiments, this testing comprises an automated test involving actuating the component automatically, and measuring its resulting behavior. For example, a sunroof motor 312 may be activated automatically for a brief time, and a sunroof encoder 314 may be checked to see whether it indicates normal motion during that time. In still other embodiments, this testing involves checking to see whether a given error code, alarm code, or status indicator has changed. Other embodiments may use various combinations of the foregoing.

In step 490, based on the information gathered in step 480, a determination is made as to whether the problem has been resolved. For example, in the case of an inoperative sunroof, the determination is made as to whether the sunroof is now operating normally. If the answer is no, the problem is not resolved, then the system or method 100 proceeds to step 495, in which service (e.g., mechanical or electromechanical service at an authorized dealer) is recommended. Such recommendations may be made via the interface engine 155 or portable device 300 through audio, through a visual interface (e.g., one comprising text, video, or symbols), or other means. If the answer is yes, the problem is resolved (i.e., the accessory, component, or subsystem is now working normally), then the system or method 100 proceeds to step 420, wherein the vehicle resumes normal operation.

These steps describe a particular embodiment of the automatic calibration and reset system or method 100 of the present disclosure. A reader of ordinary skill in the art will understand that the system or method 100 may employ additional steps not described above, or may omit one or more of the described steps, or may perform one or more steps in a different sequence than described above, while remaining within the spirit, function, and advantages of the present disclosure. In particular, delay and trigger steps may be incorporated such that, for example, if a sunroof ceases operating due to ice, then a reset or recalibration procedure is not performed until a temperature sensor and a timing loop indicate that the sunroof has warmed sufficiently. In such an example, the user may be notified of the reason for the delay, such that continued or additional malfunctions are not improperly suspected.

Additionally, certain tests may be required at certain points in particular procedures that can only be performed with the help of a user. For example, testing for a defective switch or a broken switch connection may require that the system ask the user to press or activate the switch, after which the system will look for an appropriate electrical signal, and then, if no signal is detected, ask the user to confirm that the switch was pressed or activated. If no signal was detected but the user confirms that the switch was pressed, then a hardware error (e.g., broken switch) may be suspected. Such embodiments are contemplated. It is noted that such embodiments may include advantageous arrangements wherein user action is solicited only when all autonomous interventions for a given problem have been attempted and have not been successful.

It is further noted that in some embodiments the system may include interfaces to mapping and scheduling functions external to the vehicle, such when the system advises a user to have the vehicle professionally serviced, the system may be capable of identifying an appropriate service station (either autonomously or guided by user inputs), scheduling a service appointment that fits within the schedules of both the user and the service station, sending a detailed writeup of the problem to the service station (e.g., identity of the nonworking component and all steps taken to diagnose or repair it.), and sending an automated calendar invitation to the user. Such embodiments are fully contemplated.

Figure 5:
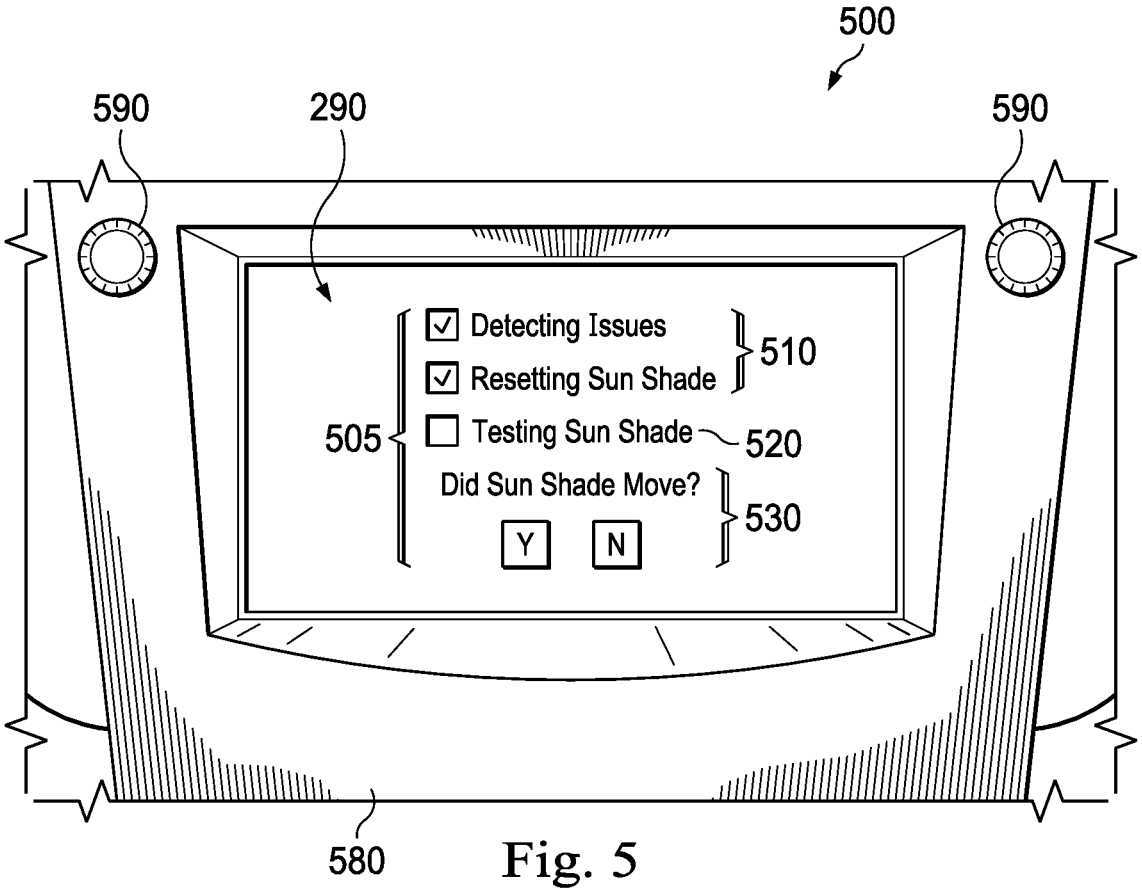
FIG. 5 is a diagrammatic illustration of an example user interrogation display according to at least one embodiment of the present disclosure.

FIG. 5 is a diagrammatic illustration of an example user interrogation display or Human Machine Interface (HMI) 500 according to at least one embodiment of the present disclosure. The HMI 500 may be interactive, and may be facilitated for example through the dashboard Head Unit (HU) 580 or through a connected smartphone using an application program interface API. In the example shown in the figure, the HMI 500 includes a text-based interface 505 on the display unit 290 of the head unit 580. Also visible are control knobs 590. In some embodiments, the HMI 500 may be a portion of, be the same element as, or be in communication with the interface engine 155 or portable device 300.

In the example shown in the figure, the text-based interface 505 includes a report of completed steps 510 that the automatic calibration and reset system has executed, and uncompleted steps 520 that the automatic calibration and reset system has not yet executed or is currently executing. In some embodiments, such reports of completed and uncompleted steps enable the automatic calibration and reset system to inform the user about the status of the automatic calibration and reset system during a fault correction procedure. The text-based interface 505 also includes a user query 530 that poses a question to the user and allows the user to respond. In some embodiments, such user queries enable the automatic calibration and reset system to acquire information from the user that may not be available from sensors internal to the vehicle. In some embodiments, such user queries 530 are limited to yes-or-no questions such as "Did the sunroof move?", "Did the sunroof make a noise?", or "Is the temperature of the sunroof below freezing?". In other embodiments, user queries 530 may solicit numerical information from the user such as ambient temperature. In still other embodiments, user queries may solicit more complex information to be interpreted by a virtual agent.

A person of ordinary skill in the art will appreciate that a variety of different interfaces may be employed to provide information to the user, to request information from the user, and to receive information from the user. It is also noted that in many examples no user interaction is required in order to detect and resolve a problem with a vehicle accessory, component, or subsystem.

Component reset, component recalibration, and system or vehicle reset are solutions for certain types of fault-based errors relating to electrical, electronic, software, and electromechanical components. The automatic calibration and reset system advantageously provides an auto-calibration or auto-reset function wherein the user does not have to perform the steps typically required to enter the vehicle into a "manufacturer's mode" where the calibration can occur. In some embodiments, the automatic calibration and reset system provides a seamless interaction between the user and the vehicle through the HU or connected device wherein the required user action is conveniently limited to describing the problem and verifying that the problem has been resolved. No physical interaction between the user and the malfunctioning subsystem is required in these instances.

A number of variations are possible on the examples and embodiments described above. For example, the display 290 could be replaced or supplemented with audible warnings, messages, flashing lights or indicators, data, and recommendations, or with haptic feedback (e.g., steering wheel vibration). The technology described herein may be implemented on manually controlled vehicles, driver-assist vehicles, or fully autonomous vehicles. The technology described herein may be implemented in diverse combinations of hardware, software, and firmware, depending on the implementation or as necessitated by the structures and modules already present in existing vehicles.

Accordingly, the logical operations making up the embodiments of the technology described herein may be referred to variously as operations, steps, objects, elements, components, or modules. Furthermore, it should be understood that these may be arranged in any order, unless explicitly claimed otherwise or a specific order is inherently necessitated by the claim language or by the nature of the component or step.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the automatic calibration and reset system. Connection references, e.g., attached, coupled, connected, and joined are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." Unless otherwise noted in the claims, stated values shall be interpreted as illustrative only and shall not be taken to be limiting.

The above specification, examples and data provide a complete description of the structure and use of exemplary embodiments of the automatic calibration and reset system as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. For example, additional sensors such as light sensors, vibration sensors, accelerometers, current sensors, or voltage sensors may be provided to help detect failed components, diagnose failure types, and confirm operational status of vehicle accessories, components, or subsystems. Additionally, sensors external to the vehicle may be employed to provide or supplement any of the sensor data described hereinabove, and processors external to the vehicle may be employed to provide or supplement any of the algorithmic steps described hereinabove. Alternatively, machine learning algorithms or other AI systems may be used to estimate variables from sparse, noisy, or entwined data streams without departing from the spirit of the present disclosure. The principles described above can be equally applied to electric vehicles, internal combustion vehicles, hybrid vehicles, autonomous and driver-assist vehicles, consumer vehicles, commercial vehicles, and mixed-use vehicles.

Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A vehicle comprising an automotive component calibration and reset system, the system comprising:

one or more components of the vehicle;

a sensor associated with a component of the one or more components, the sensor being configured to detect a malfunction of the component and generate a signal indicative of the malfunction;

a user interface; and a control unit configured to:

receive a signal from the sensor identifying at least one malfunctioning component of the one or more components of the vehicle;

automatically identify a diagnostic procedure for at least one malfunctioning component from a plurality of diagnostic procedures and initiate the identified diagnostic procedure;

determine whether a calibration or reset is procedurally indicated as part of the diagnostic procedure for the at least one malfunctioning component;

initiate an automatic calibration or reset of the at least one malfunctioning component;

initiate a test of the at least one malfunctioning component; and recommend service options to a user if a result of the test indicates the at least one malfunctioning component continues to malfunction.

2. The vehicle of claim 1, wherein the control unit is further configured to interrogate the user using the user interface regarding one or more performance parameters relating to the at least one malfunctioning component.

3. The vehicle of claim 2, wherein the control unit is further configured to interrogate the user regarding the result of the test.

4. The vehicle of claim 2, wherein initiating the test involves a user input.

5. The vehicle of claim 2, wherein the interrogation of the user involves a voice interface.

6. The vehicle of claim 2, wherein the interrogation of the user involves a visual interface.

7. The vehicle of claim 2, wherein the interrogation of the user involves a dashboard head unit.

8. The vehicle of claim 2, wherein the interrogation of the user involves a portable device.

9. The vehicle of claim 1, wherein the at least one malfunctioning component comprises an electromechanical component.

10. The vehicle of claim 1, wherein the at least one malfunctioning component comprises an electronic component.

11. The vehicle of claim 1, wherein the at least one malfunctioning component comprises a software component.

12. A method for returning malfunctioning automotive components to working condition, the method comprising:

in a processor of a vehicle communicatively coupled to a sensor of the vehicle, detecting a status of at least one malfunctioning component of one or more vehicle components by receiving a signal from the sensor;

identifying a diagnostic procedure stored in a memory from a plurality of diagnostic procedures stored in the memory;

executing the identified diagnostic procedure from the memory for the at least one malfunctioning component;

determining whether a calibration or reset is indicated as a part of the identified diagnostic procedure for the at least one malfunctioning component;

initiating an automatic calibration or reset of the at least one malfunctioning component;

performing an automated test of the at least one malfunctioning component; and if a result of the automated test indicates the at least one malfunctioning component continues to malfunction, recommending service options to a user.

13. The method of claim 12, further comprising receiving input from a user, the input selected from:

an input indicating that a component is malfunctioning;

one or more performance parameters relating to the at least one malfunctioning component; and the result of the automated test.

14. The method of claim 13, wherein the input from the user involves a voice interface or visual interface.

15. The method of claim 13, wherein the input from the user involves a dashboard head unit or portable device.

16. The method of claim 12, wherein the at least one malfunctioning component comprises an electromechanical component, an electronic component, or a software component.

17. A vehicle accessory calibration and reset module comprising:

a sensor disposed within a vehicle, the sensor being associated with a vehicle component and configured to:
detect a malfunction of the vehicle component;
generate a signal indicative of the malfunction;

a control unit configured to:
receive the signal indicative of the malfunction;
automatically identify a diagnostic procedure for the vehicle component from a plurality of diagnostic procedures and initiate the identified diagnostic procedure;
determine whether a calibration or reset is indicated as part of the diagnostic procedure for the vehicle component;
initiate an automatic calibration or reset of the vehicle component;
initiate a test of the vehicle component; and
recommend service options to a user if a result of the test indicates a malfunction status of the vehicle component.

18. The vehicle accessory calibration and reset module of claim 17, wherein the control unit is further configured to receive input from the user selected from:

the malfunction status of the vehicle component;

one or more performance parameters relating to the vehicle component; and the result of the test.

19. The vehicle accessory calibration and reset module of claim 18, wherein the input from the user involves a vehicle head unit or portable device comprising a visual interface or voice interface.

20. The vehicle accessory calibration and reset module of claim 17, wherein the vehicle component comprises an electromechanical component, an electronic component, or a software component.

* * * * *